United States Patent [19]

Proctor

[11] 4,088,088

[45] May 9, 1978

[54] PIVOTABLE RUDDER AND MEANS FOR SECURING IN VARIOUS POSITIONS

[76] Inventor: Douglas Ben Ian Proctor, "Fenmead" Brook Ave., Warsash, Hampshire, England

[21] Appl. No.: 721,829

[22] Filed: Sep. 9, 1976

[30] Foreign Application Priority Data

Sep. 24, 1975 United Kingdom ..... 39103/75

[51] Int. Cl.[2] ..... B63H 25/06

[52] U.S. Cl. ..... 114/165

[58] Field of Search ..... 114/162, 163, 164, 165, 114/167–169, 172

[56] References Cited

U.S. PATENT DOCUMENTS

| | | | |
|---|---|---|---|
| 3,575,124 | 4/1971 | Alter | 114/165 |
| 3,728,983 | 4/1973 | Ingham | 114/165 |
| 3,921,561 | 11/1975 | Arce | 114/165 |
| 3,952,682 | 4/1976 | Ingham | 114/165 |

*Primary Examiner*—Trygve M. Blix
*Assistant Examiner*—Stuart M. Goldstein
*Attorney, Agent, or Firm*—McCormick, Paulding & Huber

[57] ABSTRACT

A rudder assembly for small sailboats with a tiller which extends forwardly of a stock member and which is pivotally connected with a vertical rudder also pivotally connected to the stock member. The tiller pivot is spaced rearwardly and above the stock pivot with the rudder in its lowermost and operative position. An upright peg on the stock member respectively enters fore and aft slots in the tiller with the rudder vertical and swung upwardly to the horizontal, the latter position effected by swinging the tiller upwardly to disengage the peg from the fore slot and thereafter pulling the tiller forwardly and downwardly to enter the peg in the aft slot. A tooth on the tiller between the slots is selectively engageable with notches on the top of the peg to secure the rudder in intermediate positions. Interengaging inclined surfaces on the peg and tooth provide for automatic upward pivoting movement of the tiller releasing the peg from the fore slot and allowing the rudder to swing upwardly on the occurrence of a sharp blow or substantial force at the rudder leading edge.

6 Claims, 3 Drawing Figures

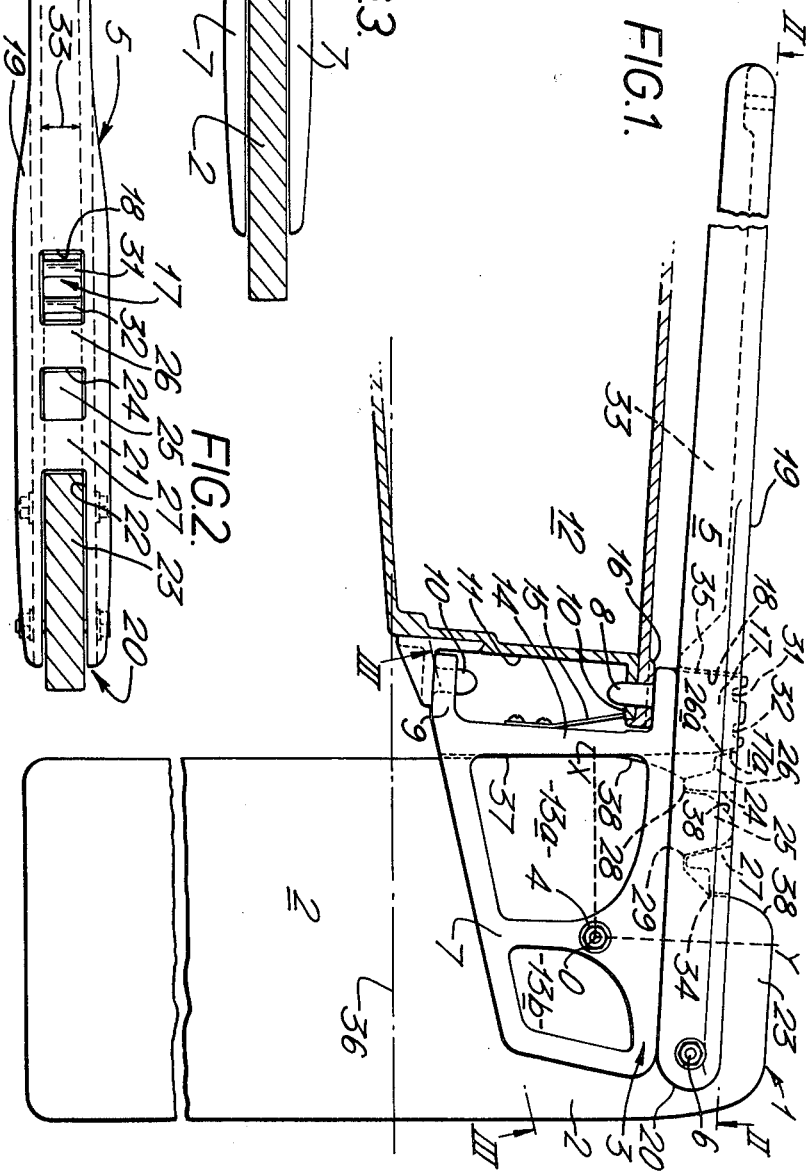
FIG.1.
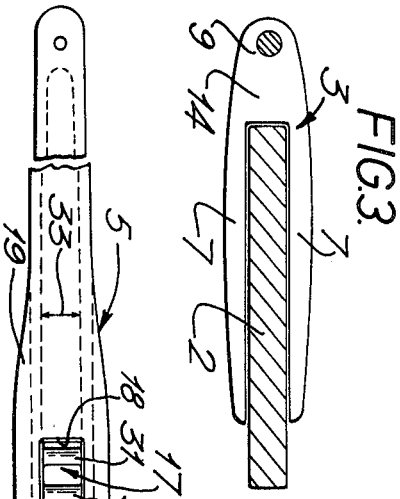
FIG.3.
FIG.2.

PIVOTABLE RUDDER AND MEANS FOR SECURING IN VARIOUS POSITIONS

This invention relates to a rudder assembly for boats, primarily for smaller boats such as sailing dinghies. Throughout the following description and claims the rudder assembly of the present invention will be described as if it were mounted for use on a boat in a substantially straight ahead condition such that the assembly lies in a substantially fore to aft vertical plane relative to the boat. The present invention is particularly concerned with a rudder assembly of the type (hereinafter referred to as "the type specified"), in which there is provided a rudder blade mounted in a substantially vertical plane on a stock member by a first substantially horizontal pivot, so that the blade is adapted to pivot in the vertical plane between lower and upper conditions.

It is often desired to raise the rudder blade while sailing, as for instance in shallow water, and according to the present invention, there is provided a rudder assembly of the type specified having an elongate tiller member which is adapted to extend forwardly of the stock member and is coupled to the rudder blade by a further substantially horizontal pivot, which, with the rudder blade in a lowermost condition, is rearward of and above the first pivot, and inter-engaging securing means on the tiller member and on the stock member; the arrangement being such that, on disengagement of the inter-engaging securing means, forward movement of the tiller member rotates the blade in the vertical plane about the first pivot, to raise the blade.

By the present invention the loads from the tiller member may be transmitted to both the rudder blade and stock member by way of the inter-engaging securing means, thereby spreading stresses throughout the assembly, and conveniently the inter-engaging securing means between the tiller member and stock member comprises a peg on one member which engages a slot in the other on downward pivotal movement of the tiller member when the rudder blade is in its lowermost condition and so restricts forward movement of the tiller member, except when the tiller member is pivoted upwardly about its pivot on the rudder blade, relative to the stock member.

A boat will normally be sailed with the rudder blade in the lowermost condition, that is, with the blade extending to its greatest depth in the water, and by the present invention, the risk of unintentional lifting of the rudder blade from that condition by pulling forwardly on the tiller member is alleviated. When sailing into very shallow water, the inter-engaging securing means should be disengaged and the tiller member pulled forwardly to lift the blade to its uppermost condition, that is, substantially out of the water, and in order to ease the task of the helmsman, the inter-engaging securing means preferably further comprises an arrangement whereby said means may be engaged to maintain the blade in the uppermost condition. Conveniently also the inter-engaging securing means further comprises an arrangement whereby the rudder blade may be restrained in one or more intermediate conditions between the lowermost and uppermost conditions. Preferably the securing means is so arranged that the tiller member may be selectively engaged with the stock member by the securing means at any one of two or more positions within its range of fore and aft travel so that the blade may be retained in any one of two or more positions within its range of movement in a vertical plane.

Conveniently, the inter-engaging securing means are adapted such that a significant rearward force, acting on the rudder blade, for example an obstruction acting in the region of the tip of the rudder blade when the boat is moving forwardly, causes the inter-engaging securing means to disengage thereby allowing the blade to lift.

According to a further aspect of the present invention there is provided a rudder assembly of the type specified having an elongate tiller member which is adapted to extend forwardly of the stock member and is coupled to the rudder blade by a further substantially horizontal pivot, which, with the rudder blade in a lowermost condition, is rearward of and above the first pivot; inter-engaging securing means on the tiller member and on the stock member adapted to be engaged and disengaged by respectively downward and upward pivotal movement of the tiller member relative to the stock member and comprising a peg carried on the stock member for engagement with a first slot in the tiller member when the rudder blade is in the lowermost condition, and for engagement with a second slot in the tiller member when the rudder blade is in an uppermost condition, the arrangement being such that with the rudder blade restrained in one of the conditions, the tiller member may be pivoted upwardly to disengage the peg from the respective one of the slots and then may be moved respectively forwardly or rearwardly so that on downward pivotal movement of the tiller member the peg may engage the other of the slots and thereby restrain the rudder blade in the other of the conditions.

The rudder assembly specified in the immediately preceding paragraph preferably includes at least one tooth carried by the tiller member and located between the first and second slots, which is adapted to engage at least one notch in the peg to restrain the blade in one or more intermediate conditions between the uppermost and lowermost conditions.

To alleviate the risk of the assembly breaking should the rudder blade strike an object under water, two or more contacting surfaces of the inter-engaging securing means should be contoured such that a significant rearward force acting on the rudder blade causes the surfaces to slide over each other so that the tiller member pivots upwardly, thereby disengaging the inter-engaging securing means and allowing the rudder blade to lift. Alternatively, or in addition to the contoured surfaces of the securing means, two contacting portions of the tiller member and of the rudder blade may be contoured to provide the same effect.

One embodiment of the present invention will now be described by way of example only with reference to the accompanying drawings, in which:

FIG. 1 is a part-sectional elevation of one side of a rudder assembly in accordance with the present invention, the rudder assembly being attached to the transom of a boat;

FIG. 2 is a part-sectional plan view of the assembly taken along the line II—II of FIG. 1, and FIG. 3 is a part-sectional plan view of the rudder assembly taken on the line III—III of FIG. 1.

The rudder assembly shown generally at 1 in FIG. 1 comprises a rudder blade 2, stock 3 comprising a pair of identical frames 7, joined together at their forward ends and between which the blade 2 is pivotally mounted by means of a bolt 4; and a tiller 5 pivotally coupled to the blade 2 by means of a bolt 6. Each of the bolts 4 and 6 may be replaced by a pivot pin as is well known in the art. With the rudder blade 2 in the lower-most condition shown in FIG. 1, that is, with the blade extending to its greatest depth below the waterline 36, the position of the pivot 6 is above and aft of the bolt 4 pivotally supporting the rudder blade on the stock 3, so that forward movement of the tiller 5 may pivot the blade upwardly.

The stock 3 carries, at its forward end, a pintle 8 and gudgeon 9 to engage the complementary fittings 10 mounted on the transom 11 of a boat 12.

The stock 3 may be a one-piece moulding in a suitable plastics material and in order to lighten the assembly each frame 7 may have infill cheeks at 13*a* and 13*b*. Alternatively, the stock may be made of wood, or as a casting in metal, for example, an aluminium alloy.

The frames 7 are joined at their forward end to a common infill member 14 which carries on its edge remote from the frames 7, a tongue 15 that engages with the gunwale 16 on the boat. The tongue 15 must be depressed to remove the assembly 1 from the boat 12. Extending upwardly from the infill member 14 of the frame 7 is a peg 17 which, in conjunction with a first slot 18 in the tiller 5, comprises inter-engaging securing means between the tiller and stock for securing the tiller and thereby restraining the blade 2 in the lowermost condition.

The tiller 5 has a channel section 33 (shown between the inner pair of dotted lines in FIG. 2) extending forwardly of the first slot 18, and the base 19 of the channel (i.e. the uppermost portion of the tiller) is broader toward the rearmost end 20 of the tiller to provide a flange 21 (shown externally of the outer pair of dotted lines) which gives the tiller increased rigidity. End 20 of the channel section 33 of the tiller is recessed to provide a second slot 22 which accommodates an upwards projection 23 of the rudder blade 2 as shown in FIGS. 1 and 2. Projection 23 gives rigidity to the assembly as a whole, particularly when the blade 2 is in its uppermost condition (i.e. pivoted through substantially 90° from its lowermost condition shown in FIG. 1), by providing an extensive bearing surface between the tiller 5 and blade 2. Second slot 22 comprises a further part of the inter-engaging securing means which may be used to retain the rudder blade 2 in the uppermost condition, as hereinafter described.

In between the first slot 18 and the second slot 22 of the tiller 5 there is provided a third slot 24 which, when the rudder blade 2 is in its lowermost condition, as shown, accommodates a part 25 of the rudder blade 2. The third slot 24 partly defines, with the first and third slots 18 and 22, teeth 26 and 27 respectively, in the channel section 33 of the tiller 5, which, in the lowermost condition of the blade 2 shown, are located in cut-out portions 28 and 29 respectively located to either side of part 25 on the rudder blade 2. The teeth 26 and 27 comprise a still further part of the inter-engaging securing means which may be used to retain the blade 2 in intermediate conditions between the lowermost and uppermost conditions.

The peg 17 and at least the uppermost portion of the rudder blade 2, are of substantially equal width to the width of the channel section 33.

When the rudder blade 2 is in its lowermost condition as shown, the projection 23 is located in the second slot 22 extending from the end part 20 of the tiller 5, the part 25 of the rudder blade 2 is located in the channel section 33 of the tiller between teeth 26 and 27, and the peg 17 and first slot 18 are engaged. Thus, stresses transmitted from the tiller 5 are spread throughout the assembly. The tiller 5 is prevented from moving forward, without being pivoted upwardly, primarily by the engagement of bearing surfaces 17*a* and 26*a* on the peg 17 and on the tooth 26 respectively.

When it is desired to raise the rudder blade 2 from its lowermost condition, the tiller 5 is pivoted upwardly about bolt 6 to disengage the inter-engaging securing means, and it may then be moved in a generally forward direction to rotate the rudder blade 2 about the axis provided by the bolt 4.

Notches 31 and 32, comprising further parts of the inter-engaging securing means, are provided in the uppermost surface of peg 17, and as the tiller is moved forward, it may be pivoted downwardly about bolt 6 so that either one of teeth 26 and 27 engages one of the notches to retain the rudder blade 2 in one of four intermediate conditions. In either of these conditions the rudder blade is partially raised, but at the same time, control of the boat 12 may be maintained by the helmsman, without his having to hold the tiller 5 under forward tension.

If it is desired to raise the blade fully to its uppermost condition, the tiller is raised and moved forwardly as far as possible. To secure the rudder in its uppermost condition, the tiller is then lowered so that contact face 34 of the tooth 27 engages the leading face 35 of the peg 17, with the peg 17 located in the second slot 22 in the tiller.

It is preferred that the location of the pivot 6 on the blade 2 and the dimensions and locations of the various parts of the inter-engaging securing means should be such that the tiller extends forwardly at a substantially equal angle to the horizontal with the securing means engaged. Further, in order to provide the assembly 1 with optimum strength, it is preferred that the outwardmost edges 38 of the rudder blade 2, between the dotted lines OX and OY in FIG. 1, all lie on an arc drawn about the bolt 4 having as radius the perpendicular distance from the aftermost edge 37 of the infill member 14 to the bolt 4.

The profiles of the bearing surfaces 17*a* and 26*a* on the peg 17 and tooth 26 respectively, are generally such that the weight of the tiller 5 and the friction at the pivot points 4 and 6 will be sufficient to resist the tendency of the tiller 5 to be pivoted upwardly and moved forward by the rudder blade 2 when water forces alone are acting upon it during normal operating conditions. At the same time, these profiles are such that an unusually severe force tending to pivot the lower portion of the rudder blade aft, such as running aground, will be sufficient to cause the bearing surface 26*a* to slide upwards over 17*a* and disengage the securing means. On this happening the tiller 5 may be moved forward under the action of the blade, and one of teeth 26 and 27 will engage with either of the notches 31 or 32, or tooth 27 will engage with leading face 35 of peg 17 to maintain the rudder blade in respectively an intermediate or the uppermost condition. All the contact faces of the teeth 26 and 27 and of the notches 31 and 32 are suitably angled to provide the facility of disengagement should a significant rearward force strike the blade 2. The force required on the rudder blade to cause disengagement of the inter-engaging securing means may be varied and controlled by adjusting the friction at pivot points 4 and/or 6 by varying the compression applied by the pivot bolts at these points, lock nuts being used to facilitate this.

The facility of disengagement of the securing means by a significant rearward force striking the rudder blade may also be provided, in the lowermost condition of the blade and in conjunction with the aforementioned contact faces or alone, by suitably contouring at least one of the contact faces between the teeth 26 and 27 and the rudder blade.

In order to alleviate the tendency of some helmsmen to lift the tiller accidentally, suitable spring biasing also may be provided, for example, between the tiller and the stock to bias the tiller downwardly. The spring biasing should not, of course, be so strong as to prevent the rudder blade 2 from lifting the tiller in the event of an unnaturally severe force driving the lowermost tip of the blade aft.

What I claim is:

1. A rudder assembly comprising a stock member adapted to be mounted on the transom of a boat, a rudder blade pivotally mounted on the stock member and swingable in a substantially vertical plane from a lowermost generally vertical operative position rearwardly and upwardly to an uppermost generally horizontal inoperative position, an elongated tiller member extending forwardly from the rudder blade and from and above the stock member and having a rear end portion pivotally connected with the rudder blade, said pivotal connection being located above and rearwardly of said pivotal mounting of the rudder blade when the rudder blade is in its lowermost position so that forward and rearward movement of the tiller member swings the rudder blade respectively upwardly and downwardly between said uppermost and lowermost positions, and inter-engageable securing means on said tiller and stock members comprising a peg on the stock member and first and second horizontally spaced slots in the tiller member, said peg and slots being so arranged that the tiller member may be swung upwardly at a forward end portion for peg and slot disengagement and for forward and rearward movement as aforesaid, and said peg and slots being selectively engageable when said tiller member is swung downwardly at its forward end portion, engagement of said peg in said first and second slots respectively securing the rudder blade in said lowermost and uppermost positions.

2. A rudder assembly as set forth in claim 1 wherein the inter-engageable securing means further comprises at least one tooth carried by the tiller member between the first and second slots, and wherein at least one notch is provided in the peg to engage the tooth and to restrain the rudder blade in an intermediate position between the uppermost and lowermost positions.

3. A rudder assembly as set forth in claim 1 wherein at least two contacting surfaces of the inter-engageable securing means are contoured such that a significant rearward force acting on the rudder blade causes the surfaces to slide over each other and the tiller member to pivot upwardly, thereby disengaging the inter-engageable securing means and allowing the rudder blade to lift.

4. A rudder assembly as set forth in claim 2 wherein a recess is provided in the upper edge of the rudder blade and receives said tooth when the rudder blade is in its lowermost position, and wherein at least two contacting portions of the tooth and recess are contoured such that a significant rearward force acting on the rudder blade causes the portions to slide over each other so that the tiller member pivots upwardly, thereby disengaging the inter-engageable securing means and allowing the blade to lift.

5. A rudder assembly as set forth in claim 1 wherein at least one of the pivotal connections between the stock member and the rudder blade, and between the tiller member and rudder blade comprises a nut and pivot bolt arrangement in which the nut may be screw-threadably adjusted on the bolt to vary the force required to raise or lower the rudder blade.

6. A rudder assembly comprising a stock member adapted to be mounted on the transom of a boat, a rudder blade pivotally mounted on the stock member and swingable in a substantially vertical plane from a lowermost generally vertical operative position rearwardly and upwardly to an uppermost generally horizontal inoperative position, an elongated tiller member extending forwardly from the rudder blade and from and above the stock member and having a rear end portion pivotally connected with the rudder blade, said pivotal connection being located above and rearwardly of said pivotal mounting of the rudder blade when the rudder blade is in its lowermost position so that forward and rearward movement of the tiller member swings the rudder blade respectively upwardly and downwardly between said uppermost and lowermost positions, and inter-engageable securing means on said tiller and stock members having at least three discrete positions of engagement and arranged to be selectively engaged and disengaged to hold said rudder blade in its said lowermost and uppermost positions and at least one fixed intermediate position, and said tiller member being manually swingable upwardly and downwardly at a forward end portion respectively to disengage and to engage said securing means at each of said three discrete positions.

* * * * *